US007781024B2

(12) United States Patent
Krüger et al.

(10) Patent No.: US 7,781,024 B2
(45) Date of Patent: Aug. 24, 2010

(54) METHOD FOR PRODUCING CERAMIC LAYERS

(75) Inventors: Ursus Krüger, Berlin (DE); Raymond Ullrich, Schönwalde (DE)

(73) Assignee: Siemens Aktiengesellschaft, Munich (DE)

( * ) Notice: Subject to any disclaimer, the term of this patent is extended or adjusted under 35 U.S.C. 154(b) by 422 days.

(21) Appl. No.: 11/922,664

(22) PCT Filed: Jun. 23, 2006

(86) PCT No.: PCT/EP2006/063516

§ 371 (c)(1),
(2), (4) Date: Dec. 20, 2007

(87) PCT Pub. No.: WO2007/000422

PCT Pub. Date: Jan. 4, 2007

(65) Prior Publication Data

US 2009/0202732 A1 Aug. 13, 2009

(30) Foreign Application Priority Data

Jun. 28, 2005 (DE) ..... 10 2005 031 101

(51) Int. Cl.
*B05D 1/02* (2006.01)

(52) U.S. Cl. ..... 427/427; 427/447; 427/180; 427/195; 427/422; 427/190; 427/202; 427/203; 427/226; 427/227; 427/228; 427/229

(58) Field of Classification Search ..... 427/427, 427/447, 180, 195, 422, 190, 202, 203, 226–229
See application file for complete search history.

(56) References Cited

U.S. PATENT DOCUMENTS 6,139,913 A 10/2000 Van Steenkiste et al.

(Continued)

FOREIGN PATENT DOCUMENTS

DE 10224/80 A1 12/2003

(Continued)

OTHER PUBLICATIONS

Dr. Lawrence T. Kabacoff; Nanoceramic Coatings Exhibit much higher Toughness and Wear Resistance than Conventinal Coatings; The AMPTIAC Newsletter; Spring 2002; vol. 6, No. 1; US.

(Continued)

*Primary Examiner*—Timothy H Meeks
*Assistant Examiner*—Marvin E Darnell

(57) ABSTRACT

The invention relates to a method for producing ceramic layers by spraying. A cold gas spraying method is used to produce polymer ceramics from pre-ceramic polymers. According to said method, a cold gas stream, to which particles of the pre-ceramic polymers are added via a conduit, is generated by a spray gun. The energy for creating a layer on a substrate is produced by injecting a powerful kinetic energy into the cold gas stream, thus preventing or significantly restricting the thermal heating of the cold gas stream. This permits the heat-sensitive pre-ceramic polymers to be spray-applied as a coating on a substrate using a cold gas spraying method. Polymer ceramics can thus be used in an economic method for the rapid production of layers with a relatively large thickness. The invention allows for example armoured layers, thermal protection layers and other functional layers to be produced.

10 Claims, 1 Drawing Sheet

U.S. PATENT DOCUMENTS

| | | | | |
|---|---|---|---|---|
| 2004/0037954 | A1 * | 2/2004 | Heinrich et al. | 427/180 |
| 2006/0141154 | A1 * | 6/2006 | Thebault | 427/249.2 |

FOREIGN PATENT DOCUMENTS

| | | | |
|---|---|---|---|
| EP | 0939143 | A1 | 9/1999 |
| FR | 2850649 | A1 | 8/2004 |
| WO | WO 8706627 | A1 | 11/1987 |

OTHER PUBLICATIONS www.presse.uni-erlangen.de%20Material.html; Neue keramische Materialien aus Kunststoffen; Jun. 9, 2004; DE.

O. Goerke et al.; Ceramic coatings processed by spraying of siloxane pörecursors (polymer-spraying); Journal of the European Ceramic Society 24; 2004; 2141-2147.

L.S. Schadler et al.; Microstructure and Mechanical Properties of Thermally Sprayed Silica/Nylon Nanocomposites; Journal of Thermal Spray Technology; Apr. 12, 1997, vol. 6, pp. 475-485.

Villafuerte J.; Cold Spray: A New Technology Welding Journal, American Welding Society May 2005; vol. 84, No. 5, pp. 24-29, XP001237822; ISSN 0043-2296; US.

Petrovicova E et al.; International Materials Reviews Inst. Mater UK Thermal spraying of polymers; Aug. 2002; vol. 47, No. 4, ISSN: 0950-6608; XP001248250; pp. 182-185.

* cited by examiner

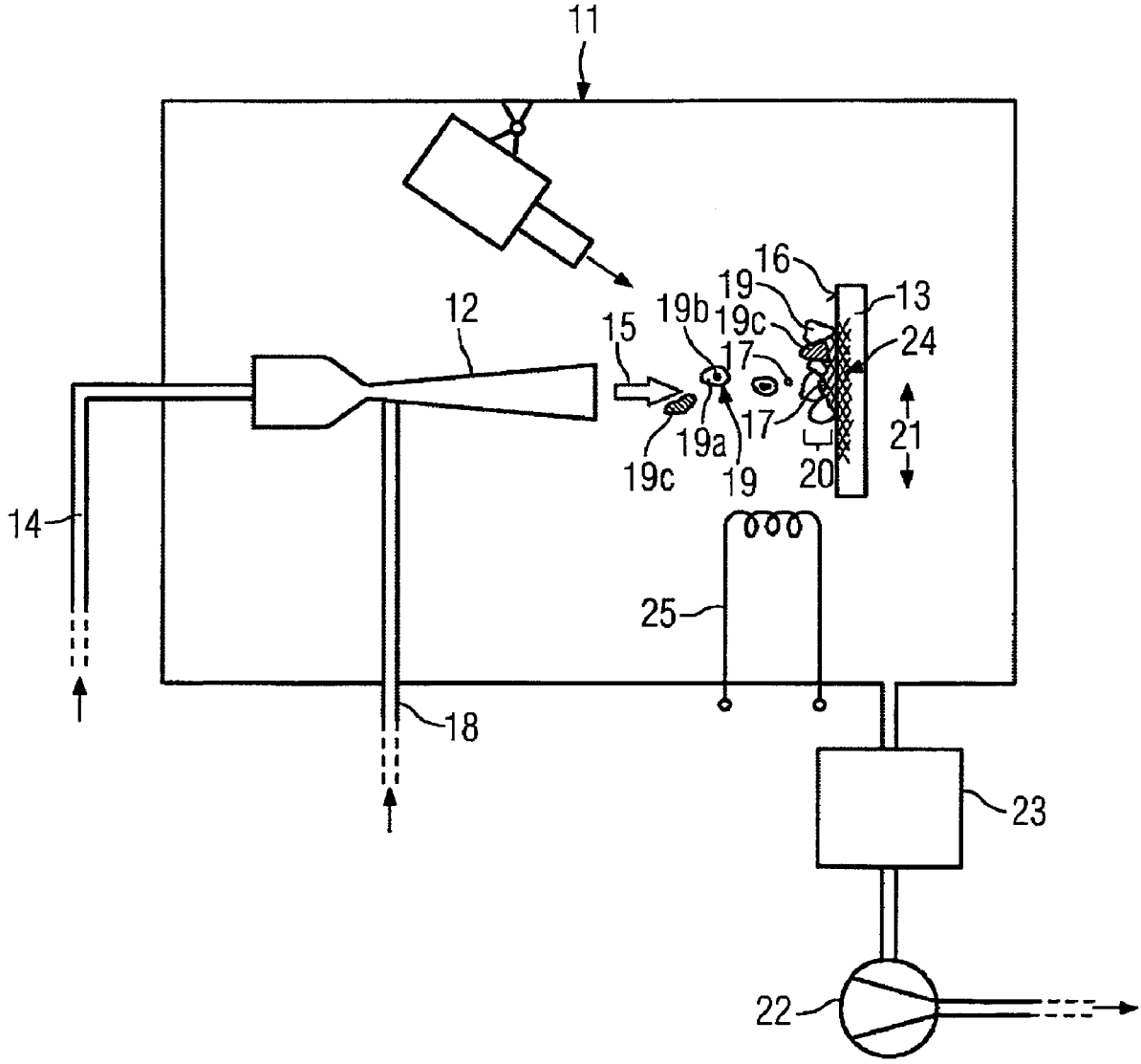
11
12
13
14
15
16
17
17
18
19
19
19a
19b
19c
19c
20
21
22
23
24
25

METHOD FOR PRODUCING CERAMIC LAYERS

CROSS REFERENCE TO RELATED APPLICATIONS

This application is the US National Stage of International Application No. PCT/EP2006/063516, filed Jun. 23, 2006 and claims the benefit thereof. The International Application claims the benefits of German application No. 10 2005 031 101.6 filed Jun. 28, 2005, both of the applications are incorporated by reference herein in their entirety.

FIELD OF INVENTION

The invention relates to a method for producing ceramic layers, wherein particles are sprayed by means of a nozzle onto the surface which is to be coated and remain adhered there.

BACKGROUND OF THE INVENTION

The production of ceramic layers by means of thermal spraying is known, for example, from a publication of the US Department of Defense (The AMPTIAC Newsletter, Spring 2002, Volume 6, No. 1). According to that publication, microparticles containing the ceramic components of the ceramic coating which is to be generated can be sprayed onto the surface that is to be coated in a thermal spraying process. The thermal spray gun generates a plasma jet into which the microparticles of the ceramic material are injected and are at least partially fused thereby. As a result of this, when the microparticles impact the substrate which is to be coated or the layer that is being constructed, a ceramic structure forms which is optionally finished by means of thermal aftertreatment.

A new class of ceramic materials has recently been developed, namely polymer ceramics. It has been explained with regard to this new ceramic class, e.g. by the chair of glass and ceramics at the University of Erlangen on the internet page www.presse.uni-erlangen.de\Aktuelles\Kerm%20Material.html (available on Jun. 9, 2004), that polymer ceramics cannot be produced using the traditional method of high-temperature annealing (sintering) of raw materials in powder form, because the ceramic raw materials (precursors) as polymers exhibit too great a thermal sensitivity for this method. Instead, it is necessary to pursue a method approach which is largely shaped by chemical techniques, in which the silicon-containing synthetic materials, which are also called pre-ceramic polymers (e.g. polycarbosilanes, polysilazanes and polysiloxanes), are converted into high-performance ceramic materials by means of thermal decomposition (pyrolysis). However, thermal spraying methods cannot be used for the production of polymer ceramics due to the lower process temperatures.

According to O. Goerke et al in "Ceramic coatings processed by spraying of siloxane precursors (polymer-spraying)", Journal of the European Ceramic Society 24 (2004), 2141-2147, it is known to deposit the precursors of polymer ceramics either as a solution or as molten material by means of spraying onto a surface, on which said precursors then remain adhered. The production of the polymer ceramic is achieved by means of a suitable thermal treatment of the coating which is obtained thus. Firstly, polymerization of the precursors is carried out at 200° C., for example. The sintering treatment for producing the ceramic can then take place at up to 1000° C.

Furthermore, according to L. S. Schadler et al in "Microstructure and Mechanical Properties of Thermally Sprayed Silica/Nylon Nonocomposites", Journal of Thermal Spray Technology, Volume 6 (1997), 475 to 485, it is possible to produce composites consisting of polymers and ceramic particles by means of thermal spraying (HVOF spraying). For this purpose the thermally sensitive polymer material is processed as particles which are covered by the ceramic material that must be embedded. These particles can be introduced into the flame jet of the thermal spraying method such that the desired polymer-ceramic composite is produced in the sprayed layer.

SUMMARY OF INVENTION

The invention addresses the problem of specifying a method for producing ceramic layers by means of spraying, which method can be used for producing polymer ceramic layers.

According to the invention, this problem is solved by the method described in the introduction, in that precursors of a polymer ceramic (which are also called pre-ceramic polymers) are used as particles and a cold-spray nozzle utilizing cold spraying is used as a nozzle. The application of the cold spraying method has the advantage that, in contrast to thermal spraying methods, the energy which is required for forming the coating is generated by virtue of a rapid acceleration (preferably to more than once the speed of sound) of the coating particles in the cold gas jet.

Cold spraying methods are disclosed generally in DE 102 24 780 A1, for example. The apparatus that is required for operating the method has e.g. a vacuum chamber in which a substrate can be positioned in front of a so-called cold-spray nozzle. For the purpose of performing the coating, the vacuum chamber is evacuated and a gas jet is generated by means of a cold-spray nozzle (also called a cold gas spray gun), whereby particles for coating the workpiece can be injected into said gas jet. These particles are rapidly accelerated by the cold gas jet such that adhesion of the particles to the surface of the substrate that must be coated is achieved by means of conversion of the kinetic energy of the particles. The particles can additionally be heated; albeit their heating is limited such that the melting temperature of the particles is not reached (this fact contributes to the naming of the term cold gas spraying).

The energy input into the coating particles, i.e. the precursors of the polymer ceramic, can be modified by adjusting the speed of the cold gas jet and possibly by additionally introducing thermal energy into the cold gas jet. It must be dimensioned such that the precursors of the polymer ceramic, which are accelerated in particle form against the surface of the substrate that is to be coated, at least remain adhered (further details on this below). As a result of this, it is possible by means of spraying to generate a coating of polymer ceramic whose properties are not jeopardized by a thermal overstressing of the particles that are to be sprayed.

According to an advantageous embodiment of the invention it is possible to supply further particles as filling material to the cold gas jet which is generated by the nozzle. In this context it is advantageously possible to utilize filling materials whose thermal sensitivity would prohibit their addition to the plasma jet of a thermal spraying method. Since the ceramics which are utilized in the case of thermal spraying methods generally have a very high melting point, the addition of filling materials is effectively excluded in the case of conventional ceramic methods.

It is advantageous, for example, if metals, in particular zircon (Zr), titanium (Ti) or aluminum (Al) or metal alloys, in particular of the cited materials, are supplied which react with the precursors of the polymer ceramic during the layer formation. In this context, it is possible to influence the composition of the polymer ceramics by means of adding active filling materials.

Furthermore, it is also advantageously possible, for example, to add a proportion of passive filling materials, e.g. silicon oxide ($SiO_2$), silicon carbide (SiC), silicon nitride (SiN), boron nitride (BN) or corundum. It is also possible to add passivated or inactive metal alloys or metals. Passivated metals are inactive because they have an oxidized surface which has ceramic properties. Inactive metals generally have a melting point which is sufficiently high that they are not involved in the reactions involved in the formation of the polymer ceramic. Noble metals such as gold (Au) or platinum (Pt) are given primary consideration.

The filling materials can be included in the cold spraying process, preferably as nanoparticles, in order to increase the reactivity. In order to allow processing using cold gas spraying, the nanoparticles must be bound to larger particles due to their very low inertia. For example, the filling materials can be embedded as nanoparticles in a matrix of pre-ceramic polymers as precursors of the polymer ceramic, with the precursors in each case forming microparticles which can be processed using the cold gas sprays. The embedding in the matrix of precursors is advantageous in the case of reactive filling materials in particular, since these can then react fully during the formation process of the polymer ceramic due to their good distribution and large surface area. A method for producing microparticles including nanoparticles which are embedded in a matrix as microencapsulation is offered by the company Capsulation® for example.

According to a further embodiment of the invention it is provided that the energy input into the cold gas jet is dimensioned such that the reaction of the precursors of the polymer ceramic is fully completed during the layer formation. This means that the precursors of the polymer ceramic are fully converted into the polymer ceramic when they strike the base (substrate or layer being constructed), and filling materials are simultaneously included in this case or react with the precursors of the polymer ceramic. As a result of this it is advantageously possible to implement an extremely efficient method because aftertreatment of the polymer ceramic layer is not necessary. A thermal aftertreatment step can be included, e.g. for the purpose of reducing internal stresses.

However, it is also possible to dimension the energy input into the cold gas jet such that adhesion of the particles is ensured, though the reaction of the precursors of the polymer ceramic is not complete and aftertreatment takes place subsequently. As part of the aftertreatment it is advantageously possible specifically to effect a conversion into polymer ceramics, this taking place in the entire layer composite that is generated, thereby advantageously reducing or even eliminating the development of manufacturing stresses. In this context aftertreatment is also understood to mean a treatment which is initiated directly after the precursors of the polymer ceramic strike, wherein said treatment already applies additional energy to the formed portion of the coating during the layer formation.

In this context it is advantageous if the aftertreatment is done e.g. by means of the energy input of electromagnetic radiation, in particular laser light, into the layer which is forming. The laser can advantageously be directed onto the point of impact of the cold gas jet, thereby ensuring that the energy input into the layer is just as localized as the cold gas jet. In this way the polymer ceramic in the coating can also be finished if the energy input into the cold gas jet is limited due to the demands of the process.

The method parameters of the energy input into the cold gas jet can advantageously also be used beneficially to influence the adhesion of the layer on the substrate. This is achieved by dimensioning the energy input into the cold gas jet, when coating the as yet uncoated substrate, such that the particles combine with the material of the substrate. In this context the condition must be satisfied that the particles are able to combine with the as yet uncoated substrate as a result of their kinetic energy upon striking said substrate, this combination consisting of covalent bonds, for example. The layer adhesion is advantageously improved as a result of this, thereby reducing e.g. the risk of the ceramic layer lifting in the event of a mechanical stress of the ceramic layer which has been generated.

BRIEF DESCRIPTION OF THE DRAWINGS

Further details of the invention are described below with reference to the drawing.

The FIGURE illustrates an apparatus for cold gas spraying.

DETAILED DESCRIPTION OF INVENTION

The apparatus of FIG. 1 features a vacuum container 11 in which are disposed on one side a cold-spray nozzle 12 that can also be designated as a cold gas spray gun and on the other side a substrate 13 (fixings not shown in greater detail). A process gas can be supplied to the cold gas spray gun 12 via a first line 14. As indicated by the contour, said nozzle has a de Laval form through which the process gas is expanded and accelerated toward a surface 16 of the substrate 13 in the form of a gas jet (arrow 15). The process gas can contain oxygen 17 as a reactive gas, for example. Moreover, the process gas can be heated in a manner which is not shown, thereby setting a required process temperature in the vacuum container 11.

Particles 19, which can be implemented as a matrix of pre-ceramic polymers 19*a* with filling materials 19*b* for the polymer ceramic that is to be formed, can be supplied to the cold-spray nozzle 12 via a second line 18. These particles are accelerated in the gas jet and strike the surface 16. The kinetic energy of the particles causes these to adhere to the surface 16, the oxygen 17 also being incorporated in the layer 20 that forms or contributing to the pyrolytic reactions of the pre-ceramic polymers. Further filling material particles 19*c* which are implemented as microparticles can also be mixed into the cold gas jet and are likewise incorporated in the layer 20.

The substrate 13 can be moved back and forth in front of the cold-spray nozzle 12 in the direction of the dual-headed arrow 21 for the purpose of forming the layer. Alternatively it is also possible to embody the cold-spray nozzle 12 such that it can be swiveled, in a manner which is not illustrated. During the coating process, the vacuum in the vacuum chamber 11 is continuously maintained by means of the vacuum pump 22, with the process gas being ducted through a filter 23 before passing through the vacuum pump 22 in order to filter out particles which did not bind to the surface 16 upon striking it.

In a boundary region 24, which is shown crosshatched in the illustration and relates to that part of the structure of the substrate 13 which adjoins the surface 16 and to those particles of the developing layer which adjoin the surface, the energy input into the layer that develops can be controlled by means of suitable adjustment of the process parameters such that good adhesion is effected between the layer 20 and the substrate 13. Covalent bonds which develop between the striking particles 19 and the substrate 13, without the surface 16 of the substrate 13 being fused, are preferably utilized in this context. It is thus possible to prevent components of the substrate 13 from being inadvertently incorporated in the layer 20 which is forming, and vice versa.

Additionally provided in the vacuum container 11 is a heater 25 so that the layer 20 can be subjected to a suitable heat treatment following production in order to bring an end to the reactions occurring in the layer 20. Said heater 25 can also be used to achieve the temperatures that are required in the vacuum chamber during the execution of the coating process. A laser 26 which can be moved by means of a suspension 27 that can be swiveled is additionally provided in the vacuum chamber 11 for the purpose of introducing a local energy input into the layer in the form of electromagnetic radiation. In particular said laser 26 can be directed at the point of impact of the cold gas jet 15 as illustrated in the FIGURE, thereby allowing for an additional external energy input, this being independent from the energy input in the cold gas jet 15, during the layer forming process.

The invention claimed is:

1. A method for producing a plurality of ceramic layers on a substrate, comprising: spraying a precursor of polymer ceramic particles onto a surface of the substrate via a cold gas spraying nozzle, wherein the particles are to remain adhered to the surface; and further particles are supplied as filling material to the cold gas jet generated by the nozzle.

2. The method as claimed in claim 1, wherein metals, or metal alloys are supplied as active filling materials which react with the precursors of the polymer ceramic during the layer formation.

3. The method as claimed in claim 2, wherein the metals are selected from the group consisting of: Zr, Ti and Al.

4. The method as claimed in claim 3, wherein ceramics or inactive or passivated metal alloys or metals are further supplied as passive filling materials which remain uninvolved in the reaction of the precursors of the polymer ceramic during the layer formation.

5. The method as claimed in claim 4, wherein the ceramics are selected from the group consisting of: $SiO_2$, SiC, SiN, BN and corundum.

6. The method as claimed in claim 5, wherein the energy input into the cold gas jet is dimensioned such that the reaction of the precursors of the polymer ceramic is fully completed during the layer formation.

7. The method as claimed in claim 2, wherein the energy input into the cold gas jet is dimensioned such that adhesion of the particles to the substrate is ensured, though the reaction of the precursors of the polymer ceramic is not complete and after-treatment of the adhered particles subsequently takes place.

8. The method as claimed in claim 7, wherein the after-treatment is effected by an energy input of electromagnetic radiation into the layer which is forming.

9. The method as claimed in claim 8, wherein the electromagnetic radiation is laser light.

10. The method as claimed in claim 9, wherein the energy input into the cold gas jet during the coating of the as yet uncoated substrate is dimensioned such that the particles combine with the material of the substrate.

* * * * *